US005626241A

United States Patent [19]

Holden

[11] Patent Number: 5,626,241

[45] Date of Patent: May 6, 1997

[54] AIRCRAFT TIRE STORAGE AND INSPECTION RACK

[76] Inventor: Peter B. Holden, 5 Welbley Ct., Sterling, Va. 20165

[21] Appl. No.: 542,778

[22] Filed: Oct. 13, 1995

Related U.S. Application Data

[63] Continuation-in-part of Ser. No. 26,036, Jul. 18, 1994, abandoned.

[51] Int. Cl.[6] ..... A47F 7/04; A47F 5/00

[52] U.S. Cl. ..... 211/23; 211/24; 211/180; 108/55.3

[58] Field of Search ..... 211/23, 24, 151, 211/180; 414/623, 426, 267, 608; D34/29; 108/55.3

[56] References Cited

U.S. PATENT DOCUMENTS

| | | | |
|---|---|---|---|
| 3,557,966 | 1/1971 | Skubic | 211/24 |
| 3,616,937 | 11/1971 | Frame | 211/24 |
| 3,812,974 | 5/1974 | Sylvester | 211/23 |

*Primary Examiner*—Robert W. Gibson, Jr.
*Assistant Examiner*—Donald J. Wallace
*Attorney, Agent, or Firm*—William F. Hamrock

[57] ABSTRACT

A storage and inspection rack for wheel and tire assemblies. The inspection rack includes an exterior tubular metal framework, a removable fire retardant protective cover and roller carriage assemblies. The frame provides a plurality of individual bays. Each bay houses a roller carriage assembly for easy loading and unloading of the wheel and tire assembly which stand upright therein.

21 Claims, 6 Drawing Sheets

AIRCRAFT TIRE STORAGE AND INSPECTION RACK

RELATED APPLICATION

This application is a continuation-in-part of design patent application Ser. No. 29/026,036 filed Jul. 18, 1994, now abandoned.

BACKGROUND OF THE INVENTION

1. Field of the Invention

The invention relates to an aircraft wheel/tire assembly storage and inspection structure and in particular to a storage and inspection structure providing storage for a plurality of different sized aircraft wheel/tire assemblies while permitting easy inspection thereof and protecting the wheel/tire assemblies from deterioration and damage.

2. Description of the Prior Art

There is a critical problem in the prior art in obtaining reliable and efficient storage and inspection structures for aircraft wheel/tire assemblies and aircraft tires. A wheel/tire assembly includes the tire attached to the wheel. This problem exists because of the large size of aircraft wheel/tire assemblies and because of the critical inspection requirements for the stored wheel/tire assemblies which when removed from storage are directly mounted onto the aircraft which immediately subjects the wheel/tire assemblies to severe operating conditions. Generally, it is required in the aircraft industry that the wheel/tire assemblies be stored on suitable racks which segregate them from commercial wheel/tire assembles. It is also required that the rack be fully adjustable with a facility for wheel/tire rotation, in situ, and that each wheel/tire assembly be separated from each other. It is further required that the wheel/tire assembles be rotated and inspected about every three months and inspection records be kept.

It is suggested in the tire industry that tires should be stored in a dark room, away from electrical and heating equipment at a constant temperature between 50 and 80 F. Care must be taken to prevent contamination of the tires by fluids of any description and damage by sharp objects. Tires should be stored vertically, side by side in tubular racks and supported by their threads at two positions so that about two thirds of their circumference is above those positions. The tires should be turned to a new position about every two to three months.

Previous attempts to produce suitable racks to accommodate the requirements of the aircraft industry have been unsuccessful. Among the deficiencies of prior art racks are the following:

(1) there is no protection from ultraviolet light;

(2) there is no protection from damage from moving equipment in the storage area;

(3) there is no protection from spilled fluids, especially from "Skydol" an aircraft hydraulic fluid which has a severely deleterious effect on the tire rubber and is used frequently for a variety of applications in aircraft maintenance;

(4) the straight rollers used for supporting the wheel/tire assemblies will not hold the assemblies upright since the wheels are heavier on the outboard side than on the inboard side;

(5) since the wheel/tire assemblies are not held upright, the assemblies rest one upon the other which makes removal extremely difficult and subjecting the remaining wheel/tire assemblies to "domino effect" when one assembly is removed;

(6) rotation of the wheel/tire assemblies cannot be accomplished when the assemblies are leaning one upon the other.

Although there are many proposed requirements and suggestions for storing aircraft wheel/tire assemblies and aircraft tires, there is a critical need for a storage and inspection structure which meets all of the requirements for inspections and storage for commercial aircraft and military aircraft wheel/assembles.

SUMMARY OF THE INVENTION

Accordingly, it is an object of the present invention to provide an aircraft tire storage and inspection structure which meets the needs of the aircraft industry and tire industry.

It is another object of the invention to provide the aircraft tire storage and inspection structure which stores a plurality of aircraft wheel/tire assembles having each wheel/tire assembly separated from one another.

It is a further object of the invention to provide the aircraft tire storage and inspection structure with an efficient roller assembly for easy loading and unloading of each stored wheel/tire assembly by one person.

It is another further object of the invention to provide the aircraft tire storage and inspection structure which has a removable covering which protects the stored wheel/tire assembles from the elements.

It is another further object of the invention to provide the aircraft tire and storage structure with a strong frame which firmly supports the structure and protects the tire assemblies from damage from other objects.

It is another further object of the invention to provide the aircraft tire storage and inspection structure which affords additional storage space for storing other materials.

These and other objects of the present invention are obtained by the present aircraft tire storage and inspection structure for aircraft wheel/tire assemblies and aircraft tires. The present structure includes a welded tubular steel frame having a steel diamond plate roof which can be used for additional storage of other items. The tubular steel frame provides support for the structure and protects the stored wheel/tire assemblies from physical damage from moving equipment and from falling objects or spilled fluids. The steel frame is structurally positioned into a plurality of individual bays, each bay housing an separate wheel/tire assembly. The steel frame is covered by fire retardant flap panels which are removable and protect the stored wheel/tire assemblies from the elements. Each bay houses a roller carriage assembly which supports one wheel/tire assembly. The roller carriage assembly includes a front and rear ramp and two separated rubber coated rollers mounted therebetween upon which the wheel/tire assembly stand upright. The front ramp has an inclined surface which permits easy loading and unloading of the wheel/tire assembly by one person.

BRIEF DESCRIPTION OF THE DRAWINGS

The structure and manner of operation of the invention, together with the further objects and advantages thereof, may best be understood by reference to the following description taken in conjunction with the accompanying drawings, in which identical reference numerals identify similar elements, and in which.

DETAILED DESCRIPTION OF THE DRAWINGS

Figure 1:
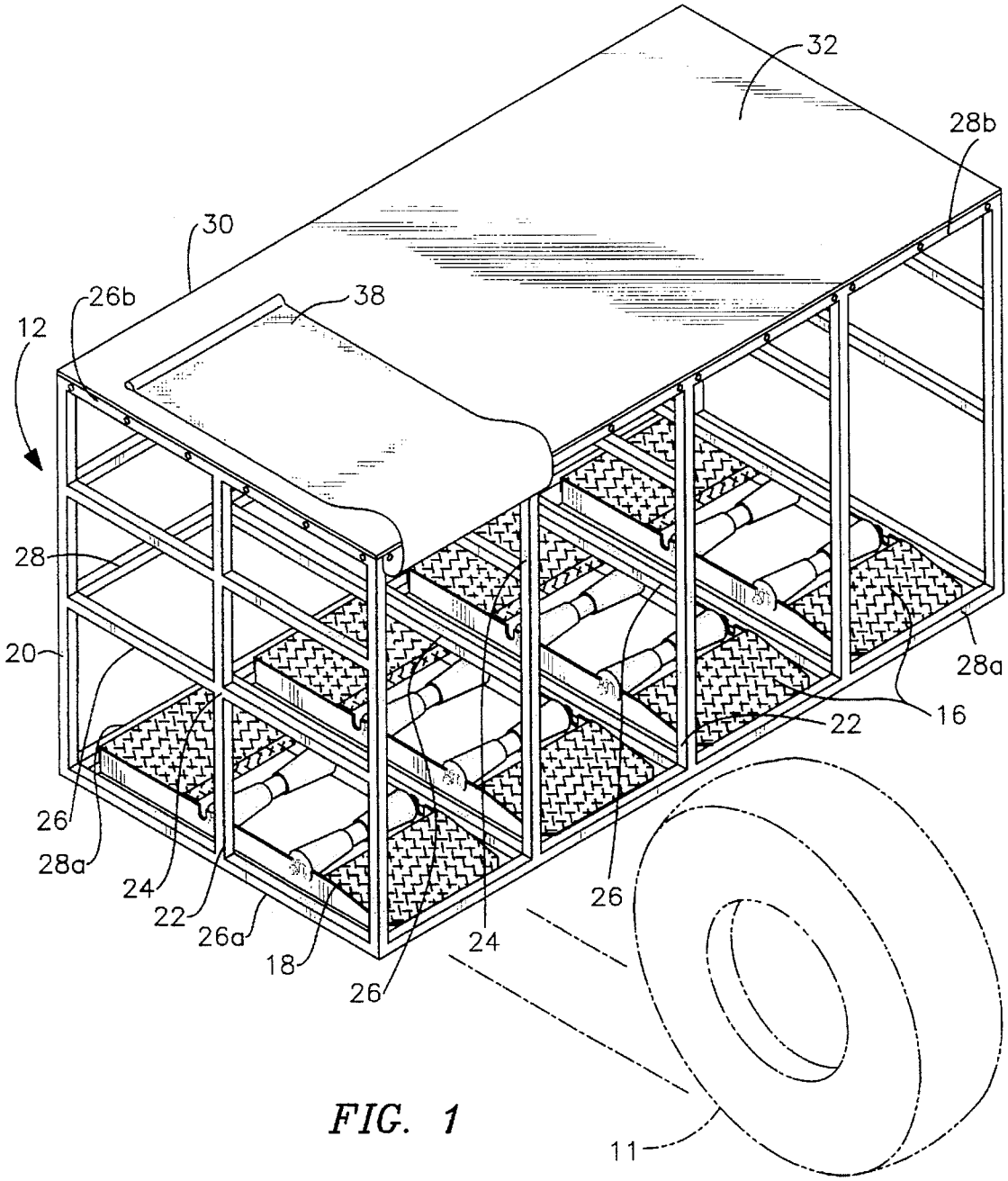
FIG. 1 illustrates a perspective view of the metal frame with most of the flap covers removed.

Referring more specifically to the drawings, the aircraft tire storage and inspection structure 10 for wheel/tire assemblies 11 is shown in FIGS. 1–5. It embodies tubular metal frame 12 enclosed within protective plastic flaps 14 and forming a number of rectangular bays 16, each bay housing a roller carriage assembly 18.

Figure 2:
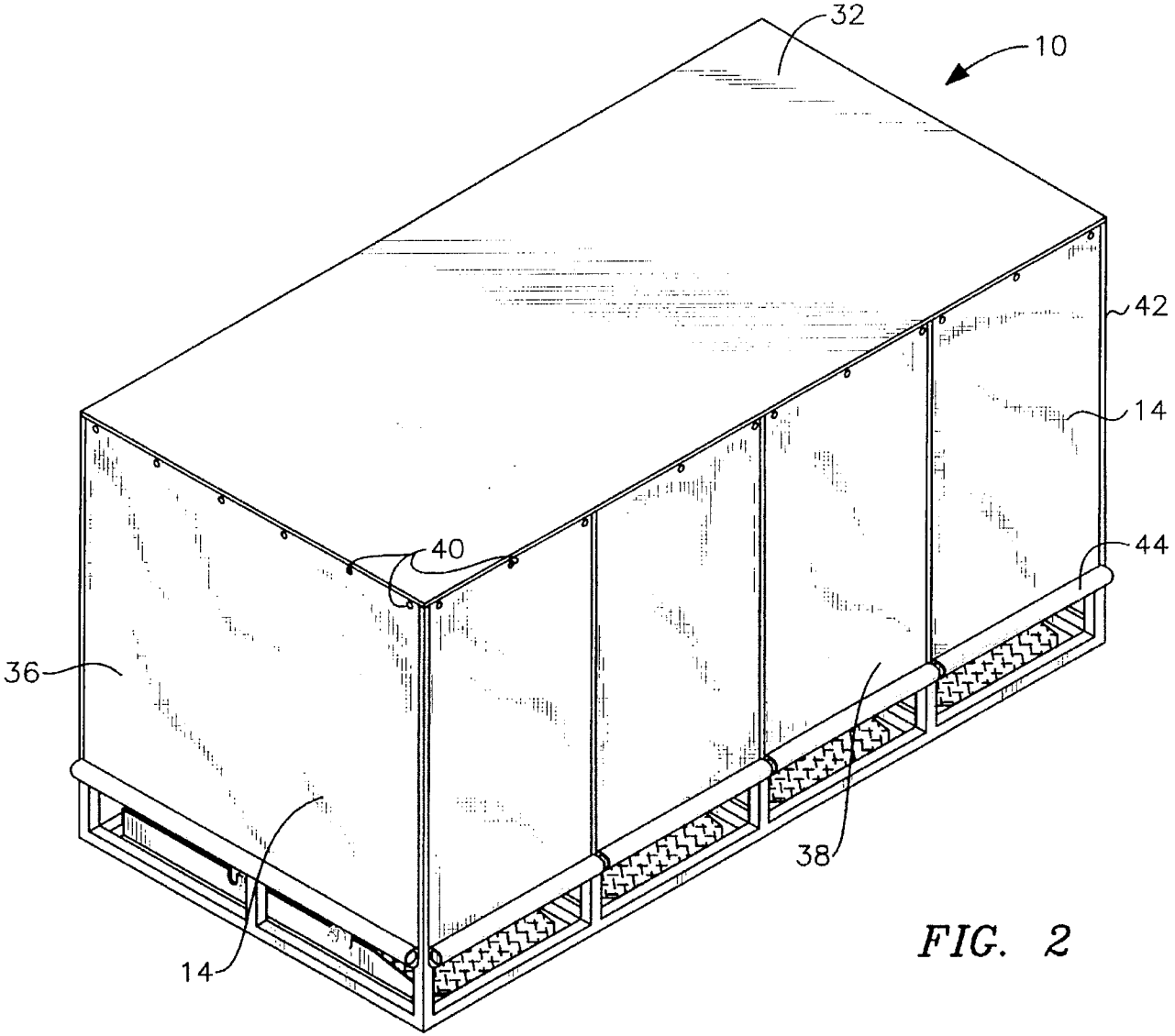
FIG. 2 illustrates a perspective view of the tire storage and inspection structure of the invention with flaps in place.
Figure 3:
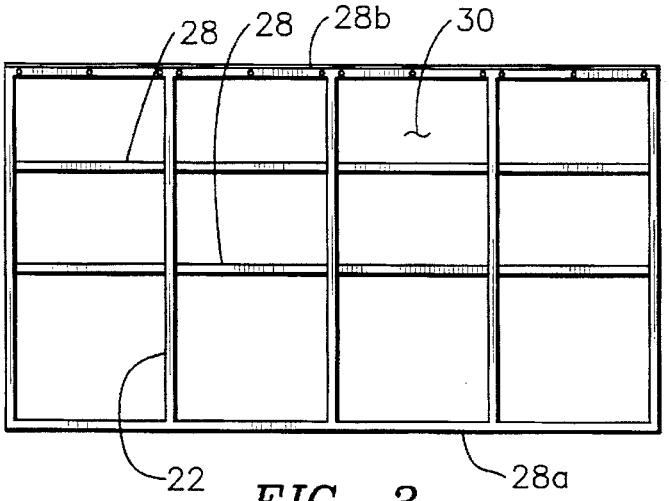
FIG. 3 illustrates a plan view of the front of the metal frame.
Figure 4:
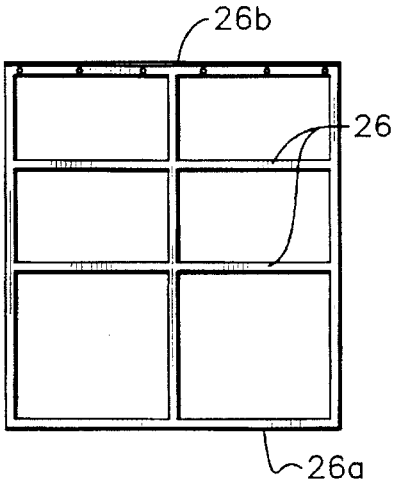
FIG. 4 illustrates a plan view of the side of the metal frame.
Figure 5:
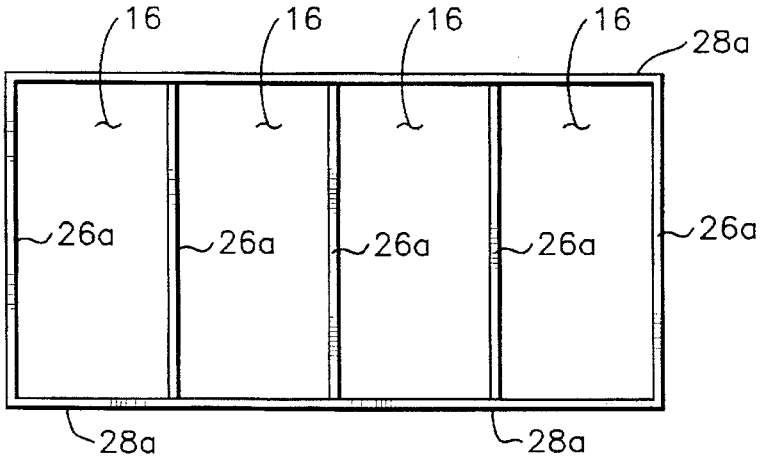
FIG. 5 illustrates a plan view of the bottom of the metal frame

Metal frame 12, as shown in FIG. 1, forms a rectangular shaped tubular structure formed from integrally joined metal tubing 20. The metal tubing includes uprights 22 forming laterally spaced succeeding side rows 24 having three uprights in each row. The three tubular uprights in each side row are integrally joined together by horizontal intermediate tubular row members 26, 26*a* and 26*b* and the side rows of tubular uprights are integrally joined to the other side rows by horizontal tubular cross members 28, 28*a* and 28*b*. Rectangular metal frame 12 is supported at its base by base supporting intermediate tubular side row member 26*a* and base supporting intermediate tubular cross member 28*a*. The metal frame is supported at the top by top supporting intermediate tubular side row member 26*b* and top supporting intermdeiate tubular cross member 28*b*. Intermediate tubular cross members 28, 28*a* and 28*b* connect horizontally across the rear 30 of metal frame 12 of tubular uprights 22 and tubular side row members 26, 26*a* and 26*b* extend horizontally between the succeeding tubular uprights 22 in each succeeding side row 24 to form individually separated parallel rectangular bays 16. Each bay is open at the front of the metal frame and connected at the rear 30, sides, bottom and top thereof by tubular uprights 22, tubular side row members 26, 26*a* and 26*b* and tubular cross members 28, 28*a* and 28*b*. Metal frame 12 as seen in FIG. 1 forms an open frame structure with four bays 16 side by side, each bay having opposing sides and a rear and an open front. Horizontal bottom tubular row members 26*a* and cross member 28*a* shown in FIGS. 1, 3, 4 and 5 engage the floor or ground to support the structure 10 while horizontal top tubular row members 26*b* and tubular cross members 28*b* support horizontal flat roof member 32. The tubular uprights 22 and horizontal tubular members 26, 26*a*, 26*b*, 28, 28*a* and 28*b*, as shown, are preferably made of welded tubular steel but other similar materials and methods of joining the members together are permissible. The flat roof member 32 shown in FIG. 2 is preferably made of 10 gage steel diamond plate one eighth of an inch thickness. Although the uprights and horizontal tubular frame members form four adjoining bays 16 in a standard structure 10, as seen in FIG. 1, there is no limit to the number of sections to meet the needs for storage and inspection. Generally, the metal frame 12 having four bays 16 is about 100.5 inches in length, about 48 inches deep and about 54 inches in height. Each bay 16 is about 23½ inches wide, 48 inches deep and 54 inches in height. The size of each bay 16 is sufficient to accommodate the wheel/tire assembly 11 size of all civilian aircraft and all military aircraft wheel/tire assembly sizes up to 49 inches by 19.5 inches.

The protective flaps 14 shown in FIGS. 1 and 2 encompasses side flap panels 36 covering the sides of metal frame 12 and the four front bay flap panels 38 each covering an individual bay 16 on the front of the metal frame. The side flap panels 36 and front bay flap panels 38 are releasably attached at their top surfaces to the structure by snap fasteners 40 such as nickel plated snap fasteners or similar releasable securing means which allow the flaps to be quickly and easily removed from the structure. Preferably, the protective flaps 14 include a one inch to 1½ inches hem 42 at its edges and having a metal stiffener 44 embedded within the bottom hem to weigh down and prevent the flaps from curling up. It is preferred that protective flaps 14 be made of a fire retardant durable plastic or similar material such as 18 oz. polyester reinforced fire retardant vinyl fabric. The protective flaps protect the wheel/tire assemblies from the deteriorating effects of ultraviolet light and further protection from spilled fluids and occasional projectile objects. The rear of the structure usually does not require a protective flap when the structure is installed against a wall. However, a protective flap for the rear of the structure may be used if required or desired. Additionally, weatherized front bay flap panels with the side edges fitted with zippers for out of doors use to provide protection from the elements as well as blown debris caused by incidental "jet-wash" or "prop-wash". Generally, the protective flaps are about 50 inches in length with the end protective flap being about 47 inches in width and the bay protective flap being about 24½ inches in width.

Figure 12:
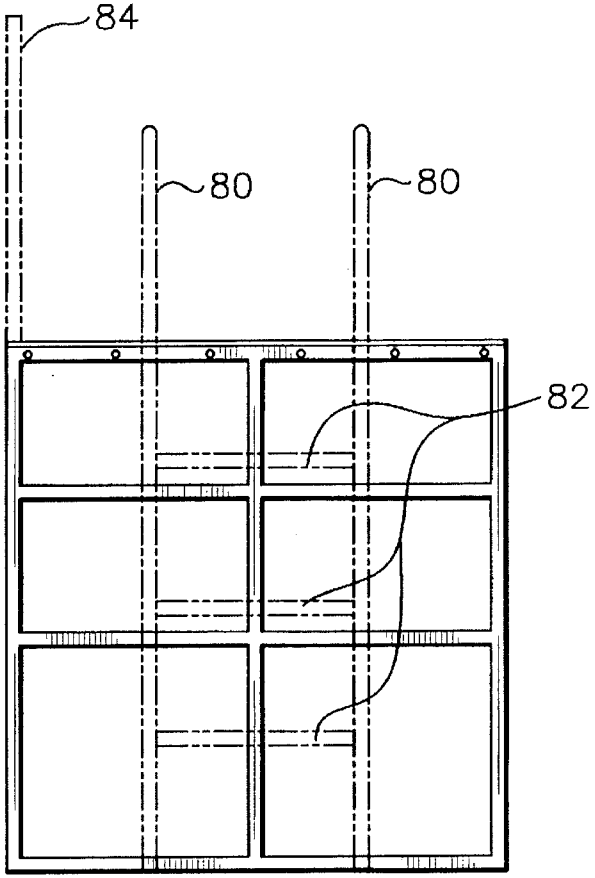
FIG. 12 illustrates a side plan view of an alternate frame.
Figure 11:
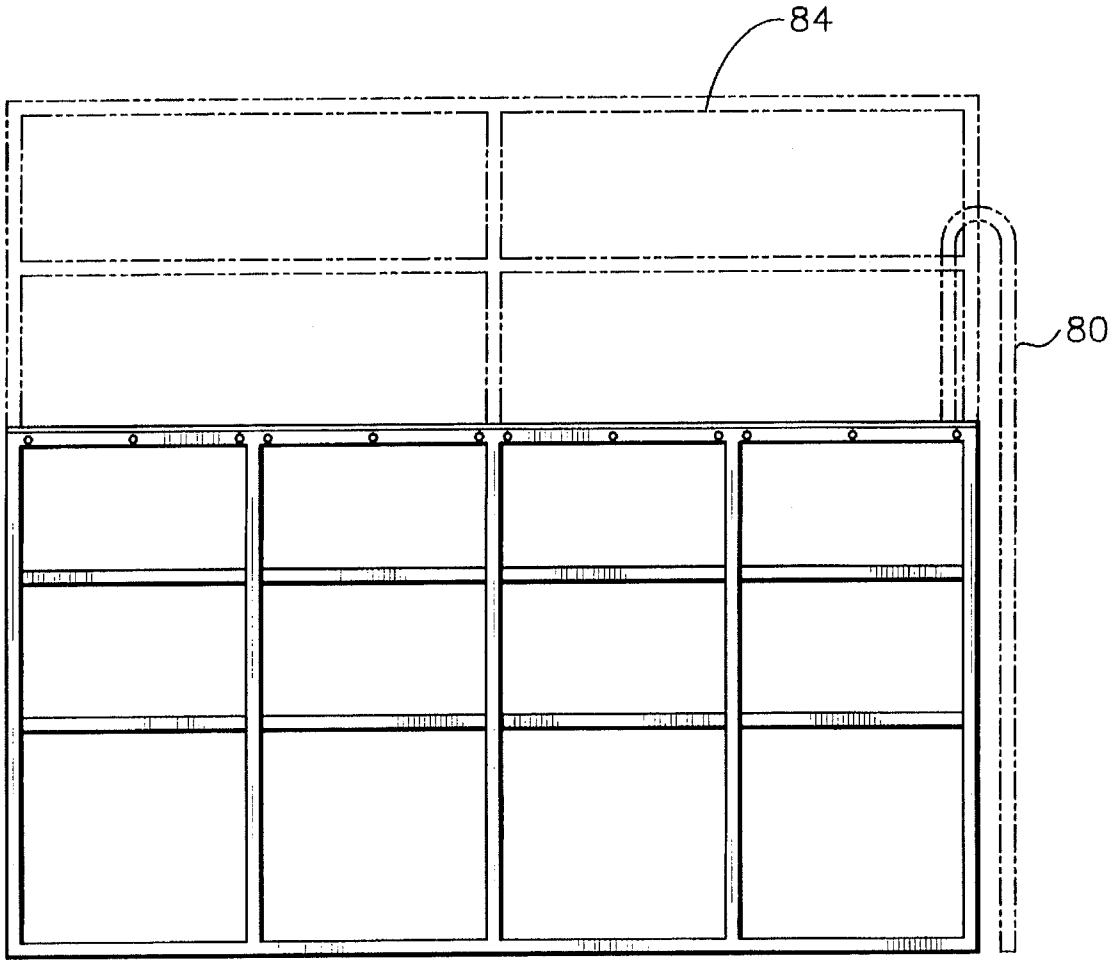
FIG. 11 illustrates a front plan view of an alternate frame.

The flat roof member 32 as seen in FIGS. 1 and 2 is made of 10 gage steel diamond plate about ⅛ inch thickness. It is secured to horizontal top tubular members 26*b* and 28*b* of metal frame 12 by welding on other suitable means. The dimensions of the roof member for the conventional four bay storage and inspection structure previously described is about 100¼ inches in length and about 48 inches in width. The roof member 32 forms a solid base support which is available for storing other materials. Safety rail and ships ladder attachment 80 as seen in FIGS. 11 and 12 is an available alternate structure when roof member 32 is used for storage. Ship's ladder 80 and rungs 82 are made of metal tubing 20 and are secured to roof member 32 by welding or similar securing means. Roof carrier frame 84 is secured to the top of metal frame 12 to protect the stored metal material.

Figure 6:
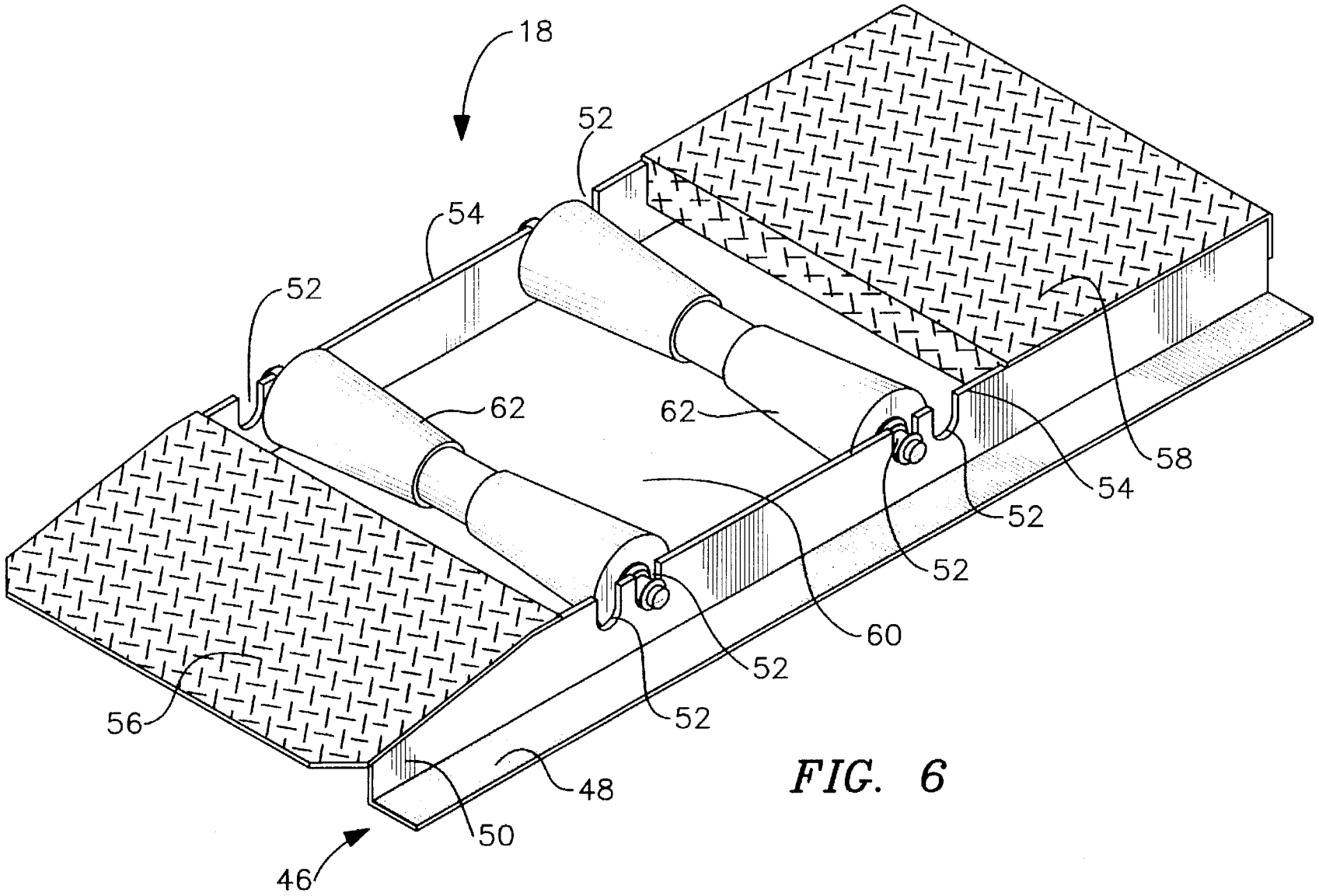
FIG. 6 illustrates a perspective view of the roller carriage assembly of the invention.
Figure 7:
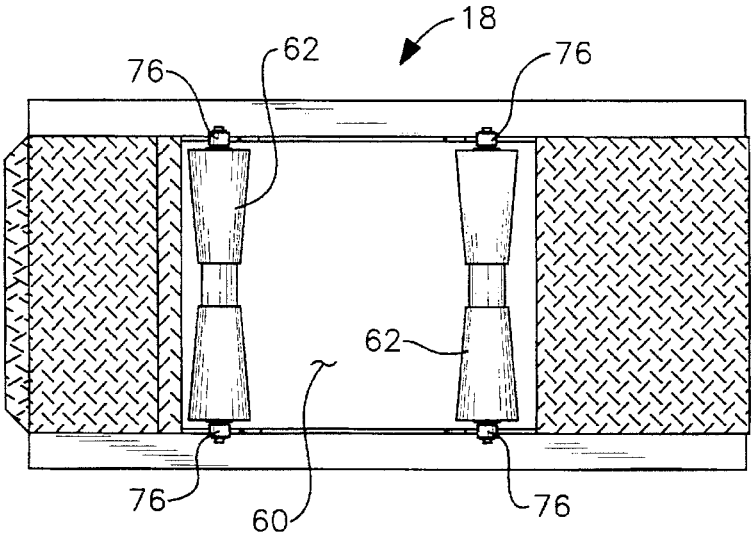
FIG. 7 illustrates a top view of the roller carriage assembly.
Figure 8:
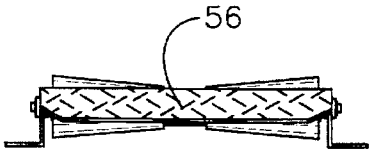
FIG. 8 illustrates a front view of the roller carriage assembly.
Figure 9:
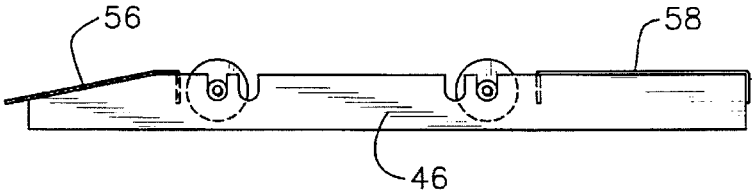
FIG. 9 illustrates a side view of the roller carriage assembly.

Each bay 16 of metal frame 12 is capable of housing a roller carriage assembly 18 as seen in FIG. 1. The roller carriage assembly as shown in FIGS. 6–10 comprises roller carriage support 46 and rollers 62. Roller carriage support 46 provides support for rollers 62 and permits adjustment of rollers 62 to accommodate wheel/tire assemblies 11. In FIG. 6 roller carriage support 46 as shown includes two opposing angle side supports extending its entire length from its front to its rear having a flat base 48 extending outwardly from perpendicular side wall 50. Side wall 50 slopes upwardly from the front of the side support and four pairs of opposing spaced apart slots 52 are located on top ledges 54 of the side supports. Inclined flat metal front ramp 56 is supported on the front upwardly sloping and leveling ledge 54 enclosing the front area of the roller carriage allowing quick and easy loading and unloading of the wheel/tire assembly by a single person. The inclined front ramp 56 provides means for easily loading and unloading wheel tire assemblies weighing up to about 500 pounds. Flat rear ramp 58 is supported on the back end of ledges 54 enclosing the back area of the roller carriage and thereby forming open space 60 in the central area of the roller carriage. Slots 52 are located on the opposing top ledges 54, two pairs of slots at the front and two pairs at the rear of open space 60 close to front ramp 56 and rear ramp 58.

Figure 10:
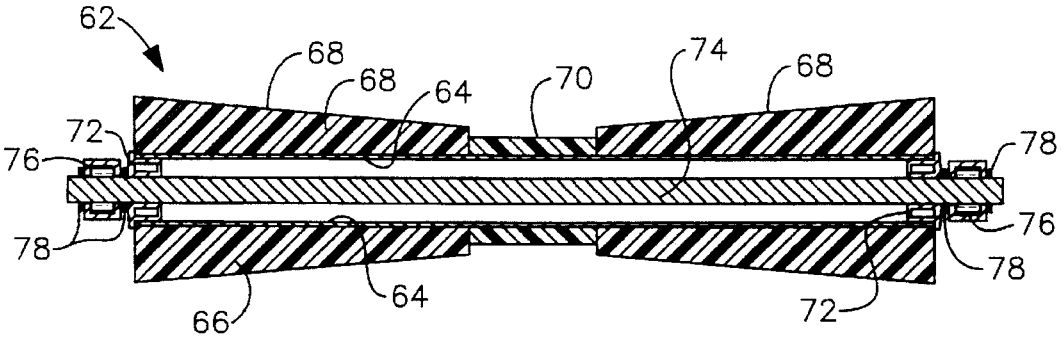
FIG. 10 illustrates a sectional view of the roller.

A pair of spaced apart rollers 62 hold the wheel/tire assembly 11 upright allowing easy visual inspections thereof and also preventing the occurrence of "flat spots" in the tires. Generally, "flat spots" are a problem with prior art racks. However, because of the unique construction and the tapered structure of the rollers shown in FIG. 10 it is not a problem here. Rollers 62 each having an inwardly tapered structure forms a cradle which holds the wheel/tire assembly 11 upright thus preventing the assembly falling over. The rollers 62 are constructed of a steel tube 64 extending the entire length of the roller. The steel tube is covered with a rubber molding 66 which is molded around or otherwise encompasses the steel tube exterior surface. The rubber molding is tapered 68 downwardly from each end towards the center forming an indented flat surface 70 in the center as seen in FIG. 10. Preferably, the rubber molding is a hard rubber material such as a neoprene rubber, preferably black in color, of about eighty durometer hardness molded around the steel tube 64. Rubber molding 66 contacts the tire at two points of contact and provides a unique contact of rubber on rubber during storage and rotation of the wheel/tire assembly. The tube is fitted at each end with cap inserts 72 having an inside diameter suitable to receive a steel shaft 74 without slippage or play, preferably about ⅝ inch diameter stainless steel shaft. Steel shaft 74 is sized to accept needle bearings 76 which fit into slots 52 on ledges 54. Needle bearings 76 provide easy rotation within slots 52 and also prevent wear of the slots. Retainers rings 78 are seen on each side of the needle bearings 76 on steel shaft 74. The retainer rings maintain the required center-to-center dimension between the needle bearings to insure proper fit of the needle bearings in slots 52 and prevent horizontal movement of the needle bearings on the shaft.

The rollers 62 are generally about 18 inches in overall length having a diameter of about 3¾ inches at the ends tapering to about 2⅜ inches at the centerline of the molded rubber steel tube 64. Preferably, steel tube 64 is a round welded steel tube having a wall thickness of about 3/32 inch. Concentricity among the shaft receiving opening in cap inserts 72, the opening in steel tube 64, and the outside diameter of the roller should be maintained within a tolerance of ⅛ inch. The unique placement of slots 52 allows three roller spacing combinations to accommodate different size aircraft tires. Roller carriage 18 of the invention accommodates tire sizes for all civilian aircraft, including new Boeing 777, as well as all military aircraft tires up to 49 inches by 19.5 inches.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A storage and inspection structure for wheel/tire assemblies and tires comprising in combination, an exterior frame having a front, a rear, two opposing sides and a top, a protective cover for the frame and at least one roller carriage assembly, said frame comprising a plurality of upright and horizontal members joined together forming a structure having a plurality of separated, side-by-side bay members, each bay member having two opposing bay sides, a rear, a front and a top, each bay member enclosed on the two opposing sides and in the rear by the upright and horizontal members, and open at the front, said protective cover comprising releasable plastic flaps mounted over the frame's opposing sides and individual plastic flaps over the front of each bay member, said roller carriage assembly housed in one bay member, said roller carriage assembly comprising two spaced apart rubber formed, inwardly tapered rollers rotatably mounted on opposing slots in opposing side supports, said rollers capable of supporting and rotating a wheel/tire assembly or tire in an upright position.

2. A storage and inspection structure according to claim 1 having a flat roof member mounted on the top of said frame.

3. A storage and inspection structure according to claim 2 wherein said flat roof member is a flat steel diamond plate.

4. A storage and inspection structure according to claim 1 wherein said upright and horizontal members are tubular members.

5. A storage and inspection structure according to claim 4 wherein said tubular members are metal tubular members.

6. A storage and inspection structure according to claim 1 wherein said releasable plastic flaps are releasably mounted to the top of said frame by snap fasteners.

7. A storage and inspection structure according to claim 6 wherein said plastic flaps are fire retardant.

8. A storage and inspection structure according to claim 7 wherein said plastic flaps comprise polyester reinforced fire retardant vinyl fabric.

9. A storage and inspection structure according to claim 1 wherein said rubber formed inwardly tapered rollers comprises a tube encompassed within a rubber surface.

10. A storage and inspection structure according to claim 9 wherein said rubber surface is a rubber material molded around the steel tube.

11. A storage and inspection structure according to claim 10 wherein said rubber material has a hardness of about 80 durometer.

12. A storage and inspection structure according to claim 9 wherein said tube is an elongated steel tube rotatably mounted at its ends in the opposing slots on the side supports.

13. A storage and inspection structure according to claim 12 wherein said side supports have a plurality of spaced apart pairs of opposing slots located at different positions for rotatably mounting said steel tube.

14. A storage and inspection structure according to claim 13 wherein said side supports have a ramp covered front, open middle and ramp covered rear areas.

15. A storage and inspection structure according to claim 14 wherein said ramp covered front area comprises an upwardly extending inclined ramp.

16. A storage and inspection structure according to claim 15 wherein said open middle area houses said rubber formed inwardly tapered rollers.

17. A storage and inspection structure according to claim 16 wherein said tube is fitted at each end with a cap insert having a central opening.

18. A storage and inspection structure according to claim 17 wherein said central opening in said cap inserts is fitted with a steel shaft extending therethrough.

19. A storage and inspection structure according to claim 18 wherein a needle bearing is mounted on each end of said steel shaft which needle bearing is mounted within the slot.

20. A storage and inspection structure according to claim 19 wherein needle bearings are enclosed within retainer rings.

21. A method for protecting, storing and inspecting wheel/tire assemblies comprising providing an exterior frame divided into a plurality of enclosed and separated, side-by-side bay members, a releasable flexible protective cover, and a roller carriage assembly housed in each bay member, said roller carriage assembly comprising two spaced apart rubber formed inwardly tapered rollers, supporting and rotating in an upright position a wheel/tire assembly, in each bay on the two spaced apart rubber rollers.

* * * * *